US005131808A

United States Patent [19]

Ciais et al.

[11] Patent Number: 5,131,808

[45] Date of Patent: Jul. 21, 1992

[54] BLADED STATOR HAVING FIXED BLADES MADE OF THERMOSTRUCTURAL COMPOSITE MATERIAL, E.G. FOR A TURBINE, AND MANUFACTURING PROCESS THEREFOR

[75] Inventors: Jean-Pierre Ciais, Blanquefort; Jacques G. Fouillot, Floriac, both of France

[73] Assignee: Societe Europeenne De Propulsion, Suresnes, France

[21] Appl. No.: 725,276

[22] Filed: Jul. 3, 1991

[30] Foreign Application Priority Data

Jul. 12, 1990 [FR] France ..... 90 08903

[51] Int. Cl.[5] ..... F01D 25/26

[52] U.S. Cl. ..... 415/135; 415/139; 415/141; 415/191; 415/200; 415/209.4

[58] Field of Search ..... 415/191, 134, 135, 139, 415/200, 209.3, 209.4, 140, 141, 208.1, 208.2; 416/190, 240

[56] References Cited

U.S. PATENT DOCUMENTS

| | | | |
|---|---|---|---|
| 3,101,168 | 8/1963 | Berchtold | 416/190 X |
| 3,188,051 | 6/1965 | Kanik | 253/78 |
| 3,363,832 | 1/1968 | Groff | 416/190 |
| 3,867,065 | 2/1975 | Schaller et al. | 415/200 X |
| 4,720,236 | 1/1988 | Stevens | 415/134 X |

FOREIGN PATENT DOCUMENTS

| | | |
|---|---|---|
| 759514 | 4/1953 | Fed. Rep. of Germany . |
| 879487 | 6/1953 | Fed. Rep. of Germany . |
| 1006122 | 1/1952 | France . |
| 1121516 | 5/1954 | France . |
| 1290012 | 2/1962 | France . |
| 2623246 | 9/1988 | France . |
| 60-21900 | 8/1985 | Japan . |

*Primary Examiner*—Edward K. Look
*Assistant Examiner*—Todd Mattingly
*Attorney, Agent, or Firm*—Weingarten, Schurgin, Gagnebin & Hayes

[57] ABSTRACT

The stator blades (10) are made of a thermostructural composite material and have asymmetric inner and outer roots (14, 16) such that at least one of the roots of an a blade presses against the outer side (**12*b*) or inner side (12*b*) of a neighboring blade. Also, each root (14, 16**) of each blade presses against the adjacent ring by a part only of its external surface, thereby allowing some flexing of the root under the effect of differential expansion between the blade and the ring.

7 Claims, 3 Drawing Sheets

BLADED STATOR HAVING FIXED BLADES MADE OF THERMOSTRUCTURAL COMPOSITE MATERIAL, E.G. FOR A TURBINE, AND MANUFACTURING PROCESS THEREFOR

BACKGROUND OF THE INVENTION

1. Field of the Invention

The present invention relates to a fixed blade assembly for a turbine or gas compressor.

A bladed stator for a turbine comprises an assembly of fixed blades arranged between inner and outer rings. FIGS. 1 and 2 show a monobloc stator with blades 1 between inner and outer rings 2 and 3.

2. Prior Art

The technologies normally employed for he manufacture of turbine stators involve casting and precision forging, whether it be for making monobloc bladed stators, or stators with assembled blades.

For operation at high temperatures, it can be envisaged to replace conventional metal or metal alloy blades with blades made of a refractory material.

However, it is difficult to envisage making the blades of solid ceramic especially sintered ceramic. Indeed, the inherent fragility of sintered ceramics limits their mechanical characteristics and resistance to thermal shocks. Accordingly, there would be difficult problems to solve in using such a material, especially as regards maintaining the blades between the inner and outer rings while avoiding any strain due to differential expansion.

For this reason, the present inventors have considered making blades using a thermostructural composite material.

Thermostructural composite materials are well known. They are formed from a refractory fibrous preform, such as carbon or ceramic fibers, densified by a refractory matrix, which may also be carbon or ceramic. Because of their fibrous reinforcement texture and their refractory composition, these materials possess good mechanical properties that make them suitable for use as structural elements, and retain their mechanical properties up to high temperatures, without exhibiting the fragility of solid ceramics.

SUMMARY OF THE INVENTION WITH OBJECTS

For this reason, the present invention has ofr object a bladed stator comprised of fixed assembled blades arranged between inner and outer rings, each blade having a portion defining an aerodynamic profile and inner and outer roots that define a separation between neighboring blades, wherein according to the invention:

the blades are made of thermostructural composite material, the inner and outer roots of each blade are asymmetrical, such that at least one of the roots of a blade presses against a inner surface or outer surface of a neighboring blade, and at least one the roots of each blade presses against an adjacent ring by a part only of its external surface, so as to allow a deflection under the effect of a differential expansion between the blade and the ring.

As explained infra, the provision of asymmetric roots for each blade, that is roots each extending only on one side of the aerodynamic profile, makes it relatively simple to build the fibrous preform for the blades. For instance, the preform can be formed from plies of fabric, or from a three-dimensional texture, such as needled texture.

Also, the specific way in which the blades fit between their rings and the elastic flexural properties of the composite material accommodate for differential expansion without risk of damage to the blade assembly.

BRIEF DESCRIPTION OF THE DRAWINGS

The invention shall be more clearly understood upon reading the following description of an embodiment, given by way of a non-limiting example only, with reference to the appended drawings in which.

DETAILED DESCRIPTION OF THE PREFERRED EMBODIMENTS

Figure 1:
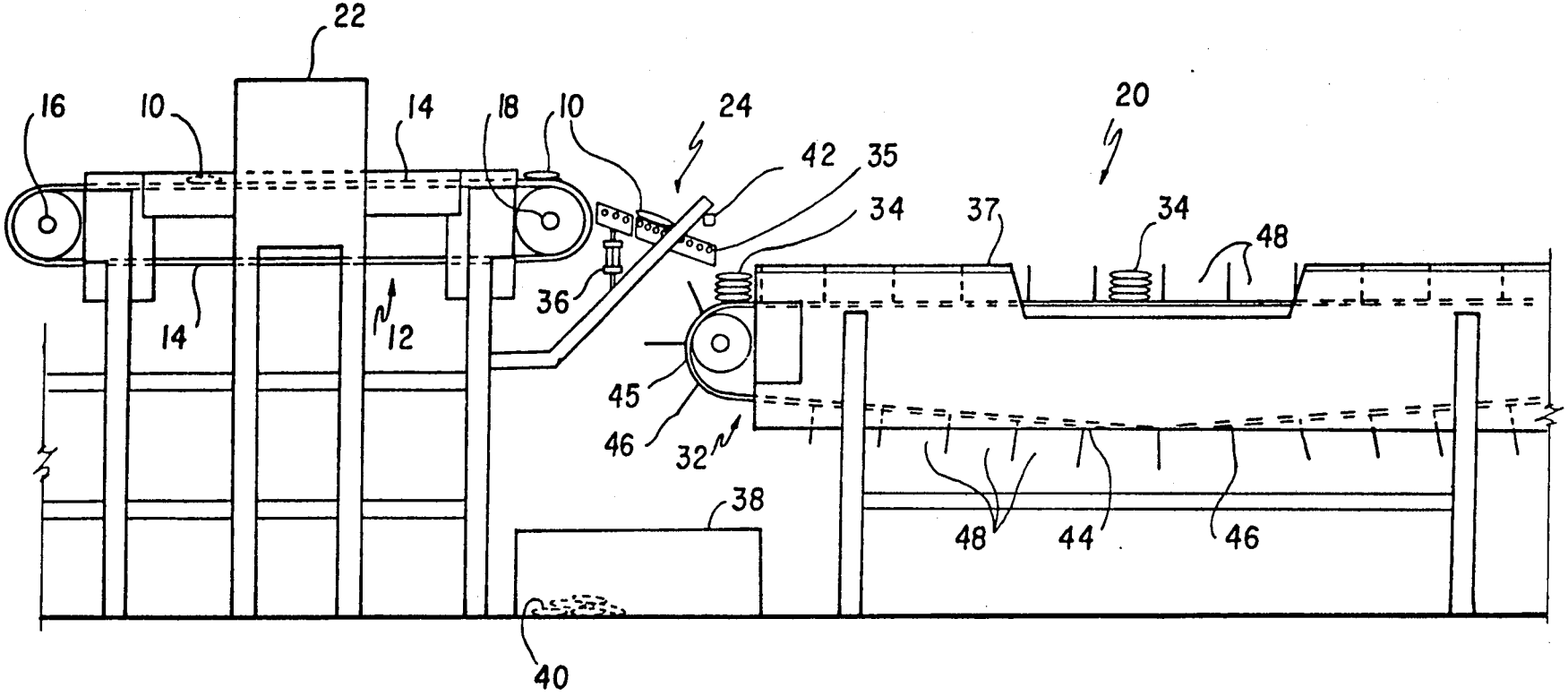
FIG. 1 is a very schematic view of part of a monobloc type of turbine stator according to the prior art.
Figure 2:
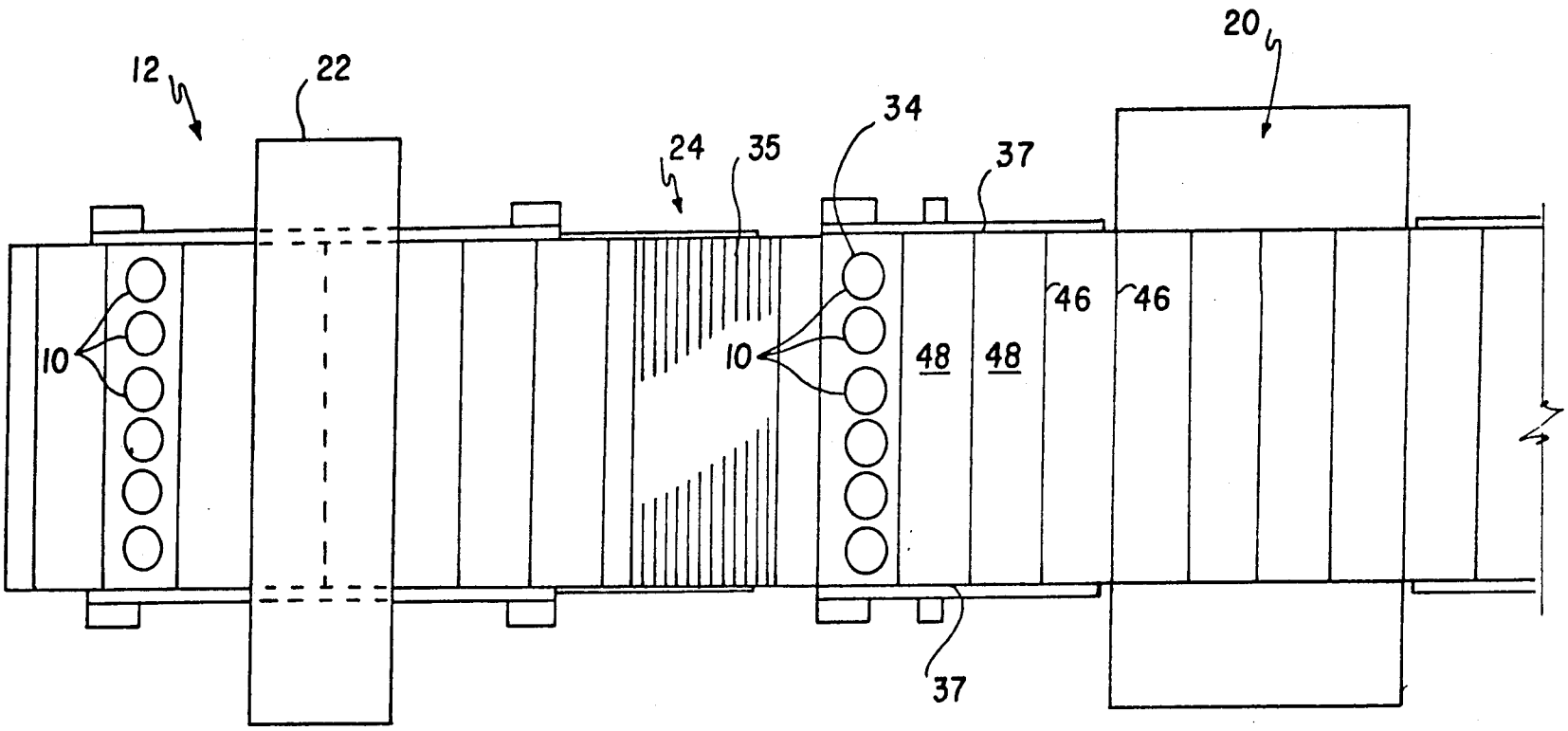
FIG. 2 is a cross-sectional view of a blade of the stator shown in FIG. 1.

A first embodiment of a turbine stator fitted with fixed blades according to the present invention shall be described with reference to FIGS. 3 to 5.

The fixed blades 10 are assembled between an inner annular ring 20 and an outer annular ring 22. Each blade is substantially C-shaped with a central portion 12 defining an aerodynamic profile from which extend two asymmetrical roots, respectively defining an inner root 14 and an outer root 16. The roots 14 and 16 extend from one and the same side of the central portion 14, namely form the inner side 12*a*.

The end edges 14*a*, 16*a* of the roots 14, 16 of one blade press against the outer side 12*b* of a neighboring blade, and thereby define the separation, or pitch, between the blades, the shape of the edges 14*a* and 16*a* being configured to match that of the outer side 12*b*.

A number of slugs 18 are lodged in holes formed in the inner faces of the rings 20 and 22 and protrude in the space between them. These slugs 18 form abutments against which press the roots of at least one blade 10 via purpose-designed cut-outs formed in the end edges of the roots. The slugs 18 determine the orientation of the blades 10 inside the space between the rings, i.e. essentially the orientation of the aerodynamic profiles 12. The slugs 18 also ensure that the blades 10 are blocked against rotation once they have been assembled.

The external surfaces 14*a* and 16*a* of the roots 14 and 16 are not perfectly cylindrical, so that they do not exactly match the inner faces of the rings 20, 22. More specifically, each root 14, 16 presses against its corresponding ring by only a portion of its external surface, in the vicinity of tis end 14*a*, 16*a*. Consequently, there is defined a gap J from the contact zone of each root, between the root and the surface of the adjacent ring. This gap can grow progressively up to the central portion 12.

The blades are made of a thermostructural composite material that exhibits an inherent elasticity in flexion. Accordingly, the gap J allows some play in the roots 10, and thereby accommodates without damage any differential expansion between the roots themselves and between the roots and the rings 20, 22, the latter being made either of same material as the blades, or of a different material, such as metallic material. During assembly at ambient temperature, the roots of the blades 10 are at least slightly pre-stressed in flexion to ensure a satisfactory grip against the internal faces of the rings.

In one variant, there can be provided a gap J between only one of the roots of each blade and the adjacent ring, the other root then conforming with the inner face of the ring against which it presses.

In another variant, the blades can define a C-shape with asymmetrical roots that both extend from the outer side.

Figure 6A:
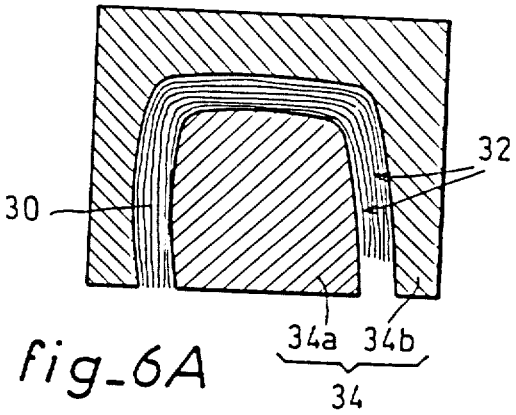
FIGS. 6A to 6C illustrate the different phases in the manufacture of a thermostructural composite material blade such as shown in FIG. 4.
Figure 6B:
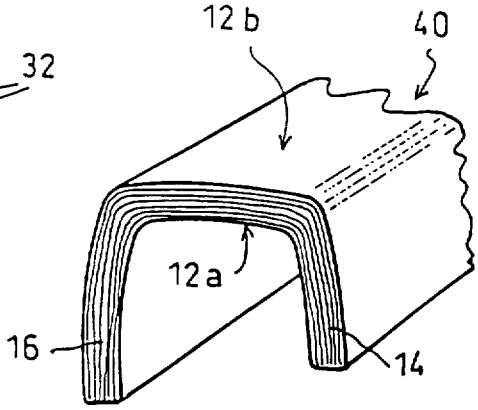

There shall now be described a process for the manufacture of blades 10 of the type shown in FIG. 4, with reference to FIGS. 6A to 6C.

The reinforcement for the composite material constituting the blades is made from a fibrous preform 30 e.g. composed of superperposed cloth plies 32 that are molded in a supporting tool 34.

The plies 32 are cut out from a cloth made of refractory fibers, e.g. carbon fibers, or ceramic fibers such as silicon carbide fibers.

The supporting tool 34 comprises a header die 34*a* having the same shape as the inner side 12*a* and the internal profiles of the roots 14, 16. The header die 34*a* cooperates with a complementary portion 34*b* of the holding tool 34 to define a volume of constant C-shaped cross-section, in which is impressed the C shape of a blade 10.

Instead of being made by superposition of cloth plies, the preform 30 may alternatively be made e.g. by conforming a three-dimensional texture of the required thickness, such as a needled structure, or a texture produced by three-dimensional weaving.

While being held by tool 34, the preform 30 is introduced in an enclosure to be densified by chemical vapor infiltration of a substance constituting the matrix of the composite material, such as silicon carbide.

Processes for chemical vapor infiltration of carbon or silicon carbide are well known in the art, and shall not therefore be described here in detail.

The infiltration can be conducted in several phases, including a first phase during which the infiltration only lasts until is obtained sufficient linking between the fibers of the preform to enable the latter to retain its shape after the tool is removed. After this consolidation phase, the chemical vapor infiltration can be pursued on the preform extracted from its holding tool, until the workpiece is completely densified (FIG. 6B).

Figure 6C:
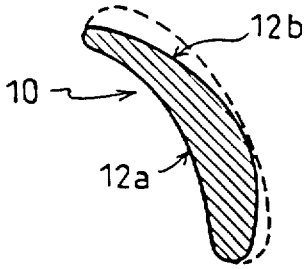

After the densification, some machining is necessary, at least to form the outer side, as shown in the cross-sectional view of FIG. 6C, and to form the outer surfaces of the roots so as to define the gap J, and to form the end edges of the roots, so that their shape corresponds to that of outer side against which they are to press.

The blades can thus be formed one by one, from the construction of the preform up to the densification and final machining.

Alternatively, it is possible to make a suitably shaped and densified workpiece having the length of several blades. In this case, the shaped workpiece is cut before machining the blades.

The design of blades with asymmetric roots makes it relatively easy to produce the fibrous preform that defines the shaped section of constant thickness, with a continuity in the cloth plies forming the reinforcement.

This would not be the case with blades having symmetric roots, such as I-shaped blades, for which it would be considerably more complex to produce the preform.

Figure 7:
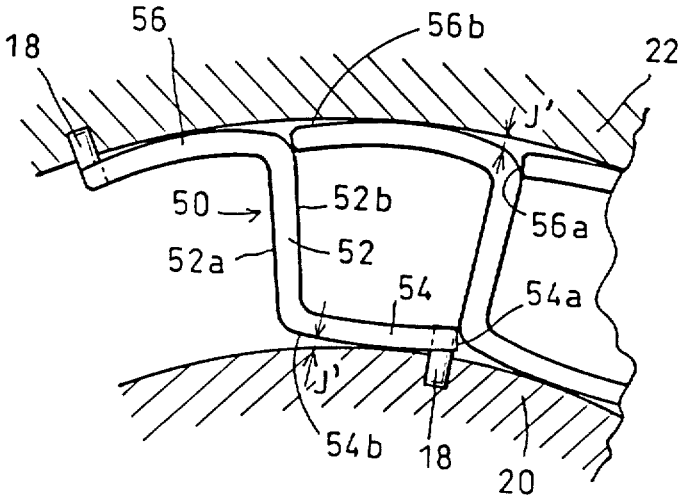
FIG. 7 is a highly schematic illustration of a portion of a turbine stator according to an alternative embodiment of the present invention.
Figure 8:
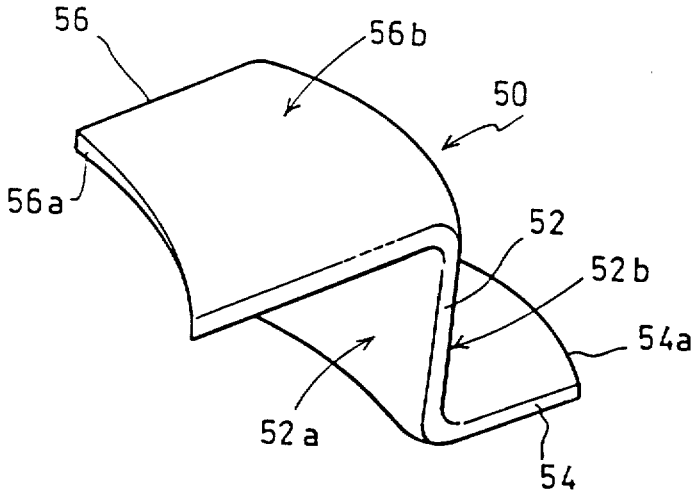
FIG. 8 is a schematic illustration in perspective of a blade of the stator shown in FIG. 7.

Another embodiment of the turbine stator according to the present invention is illustrated in FIGS. 7 and 8. The same reference numerals are used to designate the same elements of the stator depicted in FIGS. 3 to 5.

Figure 3:
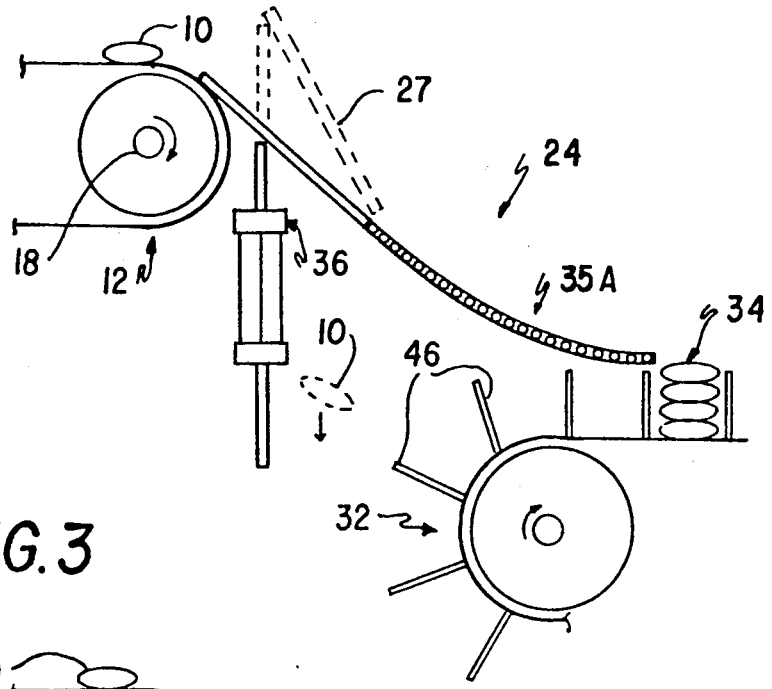
FIG. 3 is a highly schematic illustration of part of a turbine stator according to an embodiment of the present invention.
Figure 4:
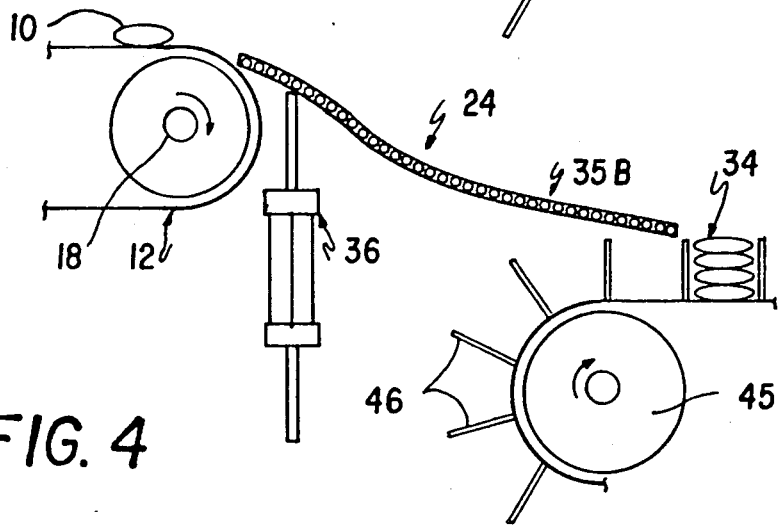
FIG. 4 is a schematic illustration in perpective of a blade of the stator shown in FIG. 3.
Figure 5:
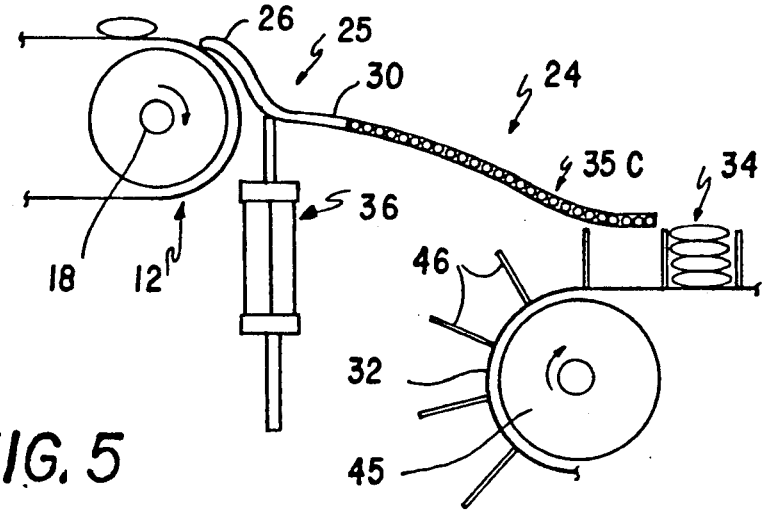
FIG. 5 is a cross-sectional view along the plane V of FIG. 4, showing the aerodynamic profile formed by the central portion of the blade.
Figure 1:
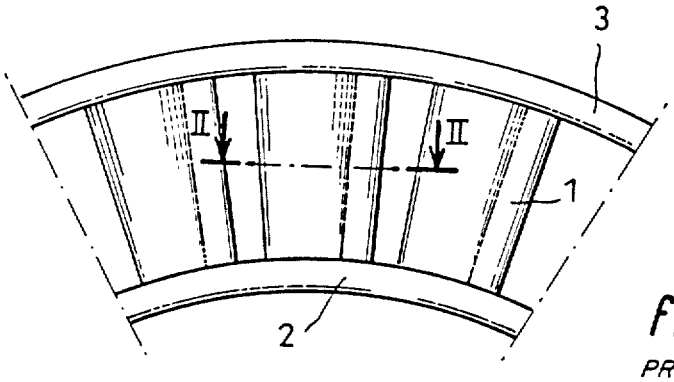
fig 1 PRIOR ART
Figure 2:
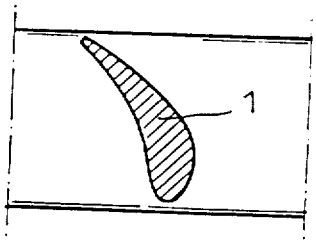
fig 2 PRIOR ART
Figure 3:
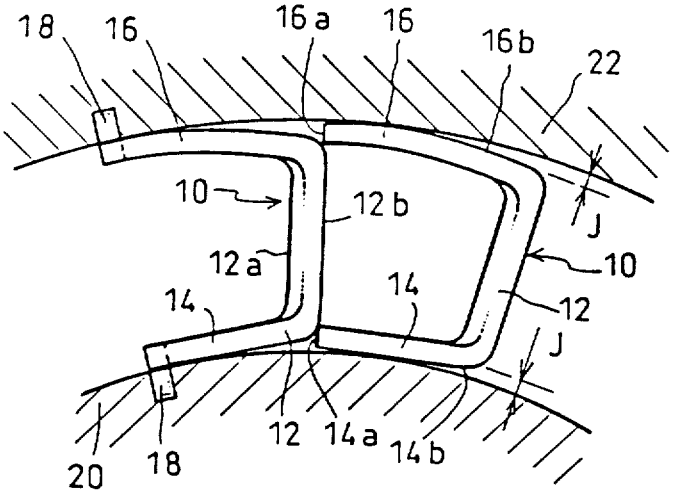
Figure 4:
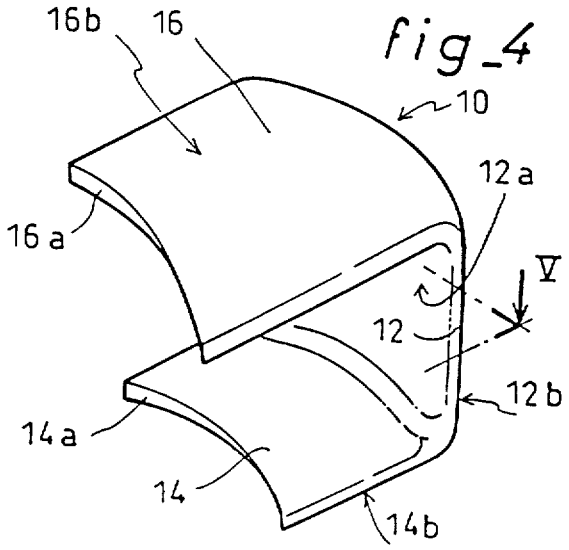
Figure 5:
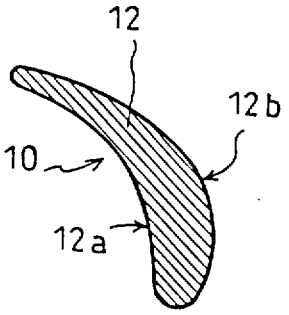

The turbine stator of FIGS. 7 and 8 differs from that FIGS. 3 to 5 by the shape of its blades 50, the latter having a Z-shape with a central portion 52 defining the aerodynamic profile, like the central portion 12 of blade 10, and asymmetric inner and outer roots 54, 56, respectively extending on the outer and inner sides 52*b* and 52*a*.

The roots 54 and 56 can, of course, be disposed the other way round.

The roots 54 and 56 of one blade 50 press by their respective end edges 54*a* and 56*a* against the the inner side of one of the neighboring blades and the outer side of the other neighboring blade, and thereby define the spacing between the blades.

The orientation of the blades 50 is determined by slugs 18 that block them from rotation.

As shown in FIG. 7, the external faces 54*b*, 56*b* of the roots 54, 56 are in contact with the internal surfaces of the rings 20, 22 only on a portion of their surface, so as to define a gap J'. The contact zone between the rots and the ring can in this case be at a short distance away from the ends of the roots, so that compensation for differential expansion occurs, at least partially, by a tilting of the roots, and not purely by a flexing of the latter.

The blades 50 are produced by forming a fibrous preform, densifying that preform and effecting a final machining. As in the previous embodiment, the preform can be made by draping plies of cloth and molding them in an appropriately shaped tool.

What is claimed is:

1. A bladed stator for a turbine comprised o fixed assembled blades arranged between inner and outer rings, each blade having a portion defining an aerodynamic profile and inner and outer roots that define a separation between neighboring blades, wherein:

the blades are made of thermostructural composite material, the inner and outer roots of each blade are asymmetrical, such that at least one of the roots of a blade bears against an inner surface or outer surface of a neighboring blade, and at least one the roots of each blade presses against an adjacent ring by a part only of its external surface, so as to allow a deflection under the effect of a differential expansion between the blade and the ring.

2. The bladed stator of claim 1, wherein said at least one root of a blade presses against an adjacent ring in a vicinity of an end of said at least one root.

3. The bladed stator of claim 1, wherein said inner and outer roots of each blade are located on a same side of said portion defining an aerodynamic profile.

4. The bladed stator of claim 1, wherein said inner and outer roots of each blade are respectively located on either side of said portion defining an aerodynamic profile.

5. The bladed stator of claim 1, wherein each root of a blade presses against an adjacent ring by a part only of its external surface.

6. The bladed stator of claim 1, wherein slugs are affixed to said inner and outer rings and edges of the roots of at least one blade press thereupon, thereby blocking said roots in a desired position between said inner and outer rings.

7. The bladed stator of claim 1, wherein said blade are made of a ceramic matrix composite material.

* * * * *

UNITED STATES PATENT AND TRADEMARK OFFICE

CERTIFICATE OF CORRECTION

PATENT NO. : 5,131,808 Page 1 of 4

DATED : July 21, 1992

INVENTOR(S) : Jean-Pierre Ciais et al

It is certified that error appears in the above-indentified patent and that said Letters Patent is hereby corrected as shown below:

The sheets of drawings consisting of Figs. 1-5 should be deleted to be Replaced with the attached sheets.

Column 1, line 13, "monóbloc" should read --monobloc--.

Column 1, line 48, "ofr" should read --for an--.

Column 1, line 60, "one the" should read --one of the--.

Column 2, line 21, "perpective" should read --perspective--.

Column 2, line 68, "tis" should read --its--.

Column 4, line 37, "rots" should read --roots--.

Column 4, line 49, "o" should read --of--.

Column 4, line 61, "one the" should read --one of the--.

Signed and Sealed this

Twenty-second Day of March, 1994

*Attest:*

Bruce Lehman

BRUCE LEHMAN

*Attesting Officer*

*Commissioner of Patents and Trademarks*